US010414526B2

(12) United States Patent
Yu Chen

(10) Patent No.: US 10,414,526 B2
(45) Date of Patent: Sep. 17, 2019

(54) BELT PRESSING STRUCTURE OF PACKING TOOL

(71) Applicant: Hsiu-Man Yu Chen, Taichung (TW)

(72) Inventor: Hsiu-Man Yu Chen, Taichung (TW)

( * ) Notice: Subject to any disclaimer, the term of this patent is extended or adjusted under 35 U.S.C. 154(b) by 337 days.

(21) Appl. No.: 15/415,244

(22) Filed: Jan. 25, 2017

(65) Prior Publication Data

US 2018/0208341 A1 Jul. 26, 2018

(51) Int. Cl.
*B65B 13/00* (2006.01)
*B65B 13/18* (2006.01)
*B65B 13/30* (2006.01)

(52) U.S. Cl.
CPC ..... *B65B 13/188* (2013.01); *B65B 13/305* (2013.01)

(58) Field of Classification Search
CPC ..... B65B 13/22; B65B 13/188; B65B 13/025; B65B 13/327; Y10T 156/18
See application file for complete search history.

(56) References Cited

U.S. PATENT DOCUMENTS 6,332,306 B1 * 12/2001 Finzo ..... B65B 13/327 53/582
7,455,080 B2 * 11/2008 Crittenden ..... B65B 13/025 140/123.5
7,497,068 B2 * 3/2009 Nasiatka ..... B65B 13/025 100/33 PB
9,403,609 B2 * 8/2016 Bonifazi ..... B65B 13/025
2015/0353217 A1 * 12/2015 Yu Chen ..... B65B 13/025 100/6

* cited by examiner

*Primary Examiner* — Matthew Katcoff
(74) *Attorney, Agent, or Firm* — Sinorica, LLC

(57) ABSTRACT

A belt pressing structure of a packing tool is provided. The packing tool includes a main body. The main body is provided with a belt pressing device, a belt winding device, and a power device. The belt pressing device includes a belt pressing seat. The belt pressing seat is pivotally connected with a handle. When in use, the user can hold the main body with one hand to lift the handle for the belt pressing device to form a passage, and a packing belt is inserted through the passage. After that, the handle is released, so that the packing belt is pressed and retained by the belt pressing device. The packing belt is tightened by using the belt winding device. Finally, the unnecessary packing belt is cut by the belt cutting device to complete the packaging operation.

9 Claims, 6 Drawing Sheets

BELT PRESSING STRUCTURE OF PACKING TOOL

FIELD OF THE INVENTION

The present invention relates to a belt pressing structure, and more particularly to a belt pressing structure of a packing tool.

BACKGROUND OF THE INVENTION

A packing belt is always used to pack goods by means of a packing tool for transportation. A conventional packing tool comprises a main body. The main body is provided with a cutting device, a tightening device, and a belt pressing device. The belt pressing device is provided with a handle. A grip end of the handle is disposed on the top of the main body. After the packing belt is wound around an article to be packed, the user presses the handle down and one end of the packing belt is inserted through the belt pressing device. After that, the handle is released so that the packing belt is pressed and retained by the belt pressing device, and then the packing belt is inserted through the tightening device to be gradually tightened. Finally, the unnecessary packing belt is cut by the cutting device to complete the packaging operation.

However, the handle is provided with a cam to rotate a cam of the belt pressing device. The cam cannot be rotated efficiently due to its angular limitation. Besides, the grip end of the handle is disposed on the top of the main body. When the user holds the main body of the packing tool with one hand, it is necessary to loosen the palm of the hand with the finger to pull the main body of the packing tool, and the part of the hand between the thumb and the index finger is moved upward to the grip end of the handle to operate the belt pressing device, such that the main body cannot be held tightly to increase a risk of use. Accordingly, the inventor of the present invention has devoted himself based on his many years of practical experiences to solve these problems.

SUMMARY OF THE INVENTION

The primary object of the present invention is to provide a belt pressing structure of a packing tool. The packing tool comprises a main body. The main body is provided with a belt pressing device, a belt winding device, and a power device. The belt pressing device includes a belt pressing seat. The belt pressing seat is fixed to the main body. A first side of the belt pressing seat is pivotally connected with a handle. The handle has a toothed portion and an accommodation portion. A return spring is provided in the accommodation portion. An elastic end of the return spring leans against the main body. The belt pressing seat has a through hole. The through hole is provided with a shaft and a spring. A first end of the shaft is provided with a gear. The gear meshes with the toothed portion. A second end of the shaft extends out of the belt pressing seat and is sleeved with an interlocking block. The interlocking block is pivotally connected with a belt pressing block. The spring is fitted on the shaft. A fixed end of the spring is connected to the shaft. An elastic end of the spring leans against the belt pressing block. A second side of the belt pressing seat is provided with a press plate corresponding to the belt pressing block. Thereby, the handle is operated to drive the gear through the toothed portion to lift the belt pressing block so that a passage is formed between the belt pressing block and the press plate.

DETAILED DESCRIPTION OF THE PREFERRED EMBODIMENTS

Embodiments of the present invention will now be described, by way of example only, with reference to the accompanying drawings.

Figure 1:
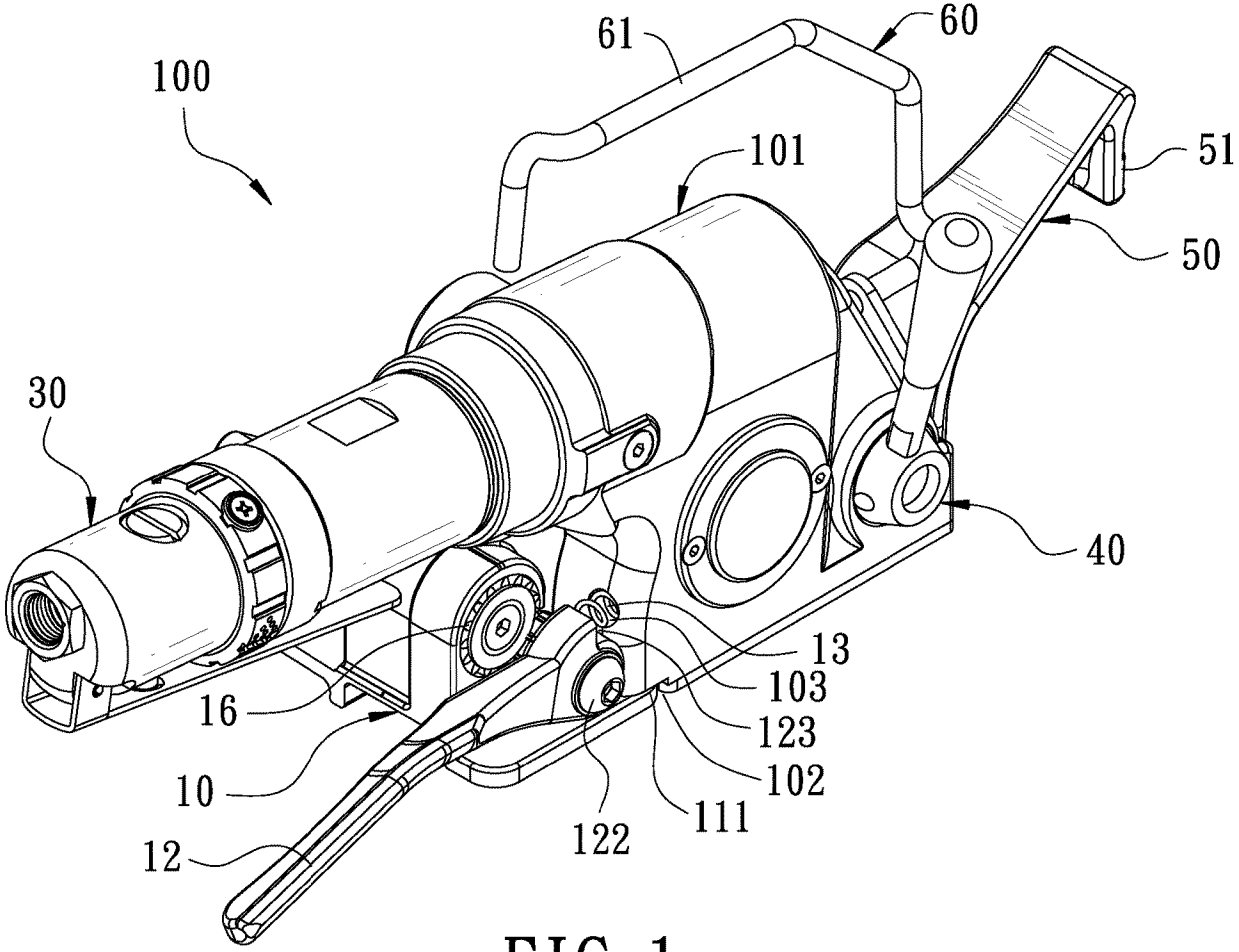
FIG. 1 is a perspective view of the present invention.
Figure 2:
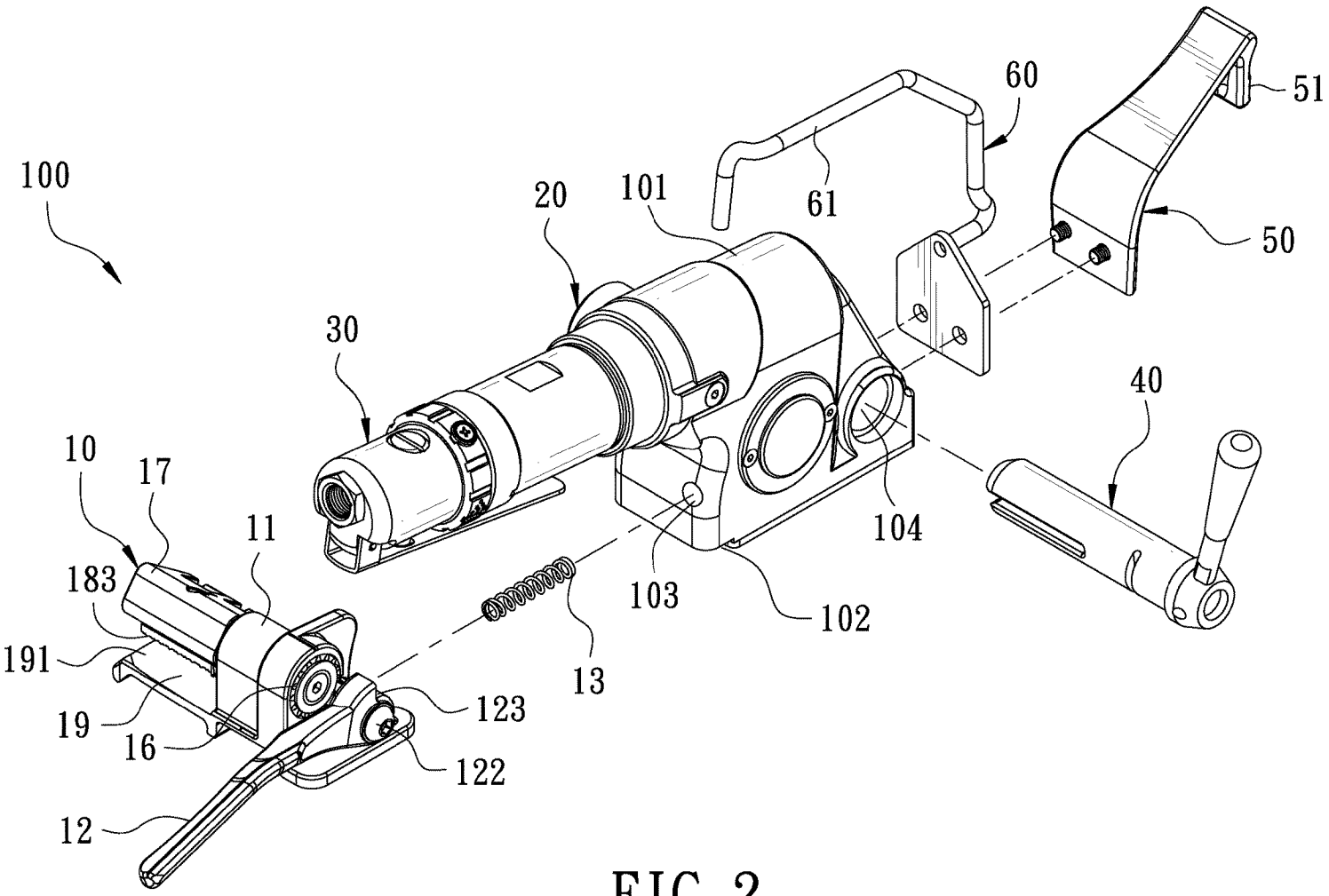
FIG. 2 is a partial exploded view of the present invention.
Figure 3:
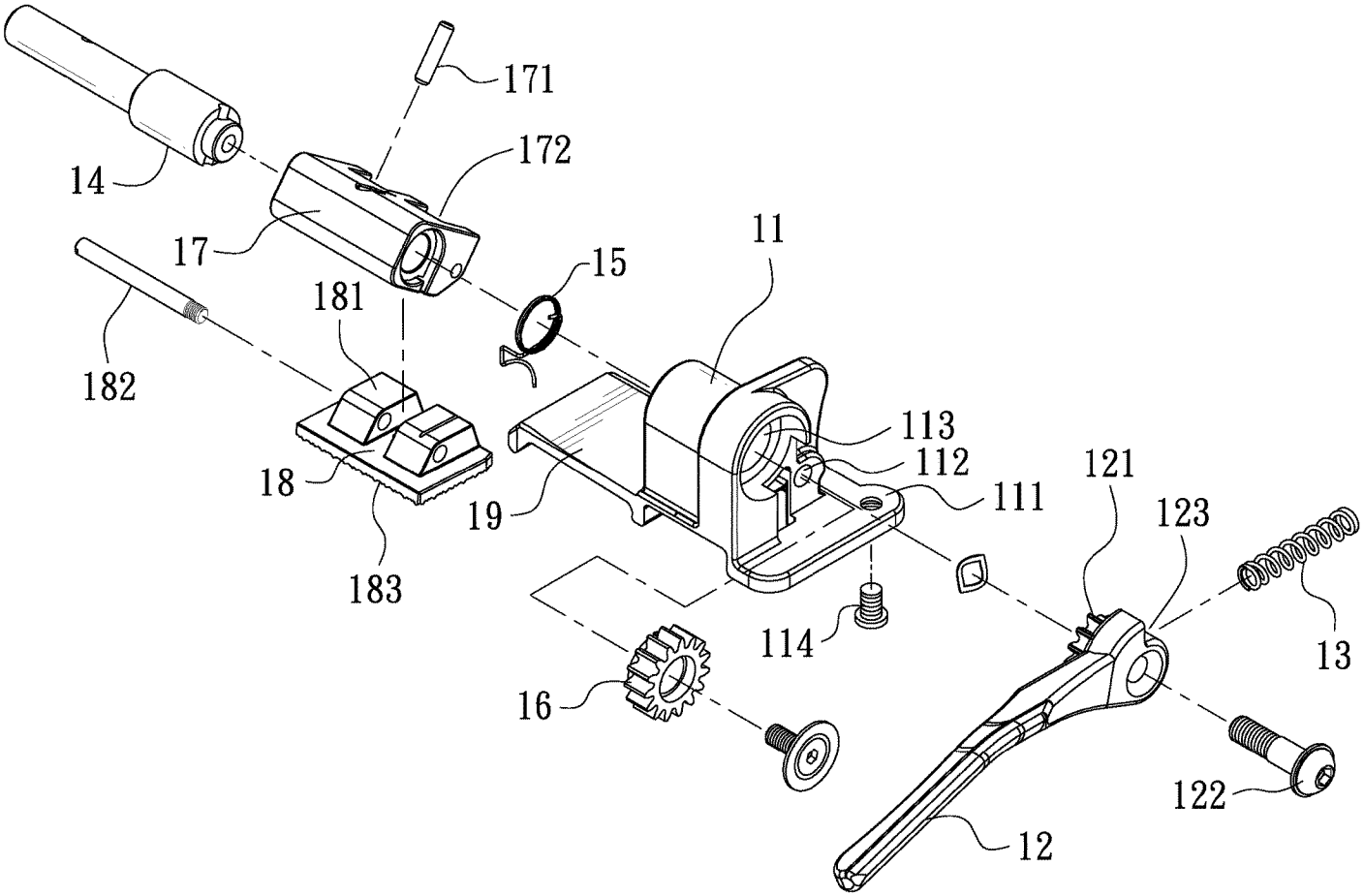
FIG. 3 is an exploded view of a belt pressing device of the present invention.

FIG. 1 is a perspective view of the present invention. FIG. 2 is a partial exploded view of the present invention. FIG. 3 is an exploded view of a belt pressing device of the present invention. The present invention discloses a belt pressing structure of a packing tool. The packing tool 100 comprises a main body 101. The main body 101 is provided with a belt pressing device 10, a belt winding device 20, a power device 30, and a belt cutting device 40.

The main body 101 has a recess 102 at a bottom thereof. One side of the main body 101 has an accommodation hole 103 corresponding to the belt pressing device 10. The main body 101 further has a mounting hole 104.

The belt pressing device 10 includes a belt pressing seat 11. The belt pressing seat 11 is fixed to the main body 101 and located under the power unit 30. The belt pressing seat 11 includes a fixed plate 111 corresponding to the recess 102. The fixed plate 111 is fixed to the recess 102 with a screw 114. A first side of the belt pressing seat 11 is pivotally connected with a handle 12. In an embodiment of the present invention, the first side of the belt pressing seat 11 has a pivot hole 112. The handle 12 is fixed to the pivot hole 112 with a fixing member 122. The handle 12 has a toothed portion 121 and an accommodation portion 123. A return spring 13 is provided in the accommodation portion 123. An elastic end of the return spring 13 leans against the accommodation hole 103 of the main body 101. The belt pressing seat 11 has a through hole 113. The through hole 113 is provided with a shaft 14 and a spring 15. A first end of the shaft 14 is provided with a gear 16. The gear 16 meshes with the toothed portion 121. A second end of the shaft 14 extends out of the belt pressing seat 11 and is sleeved with an interlocking block 17. The interlocking block 17 is provided with a pin 171. The pin 171 is inserted in the interlocking block 17 and the shaft 14. The interlocking block 17 has two limit recesses 172. The interlocking block 17 is pivotally connected with a belt pressing block 18. The belt pressing block 18 includes two limit blocks 181 corresponding to the limit recesses 172, respectively. A pivot 182 is inserted through the limit recesses 172 and the limit blocks 181. The bottom surface of the belt pressing block 18 has a bite surface 183. The bite surface 183 is serrated. The spring 15 is fitted on the shaft 14. A fixed end of the spring 15 is connected to the shaft 14, and an elastic end of the spring 15 leans against the belt pressing block 18. A second side of the belt pressing seat 11 is provided with a press plate 19 corresponding to the bite surface 183 of the belt pressing block 18.

The power device 30 is a pneumatic motor.

The belt cutting device 40 is mounted to the mounting hole 104 of the main body 101.

A press member 50 is screwed to a front end of the packing tool 100. The press member 50 has a press surface 51.

A hanger 60 is screwed to the front end of the packing member 100. The hanger 60 includes a fixing bar 61

Figure 4:
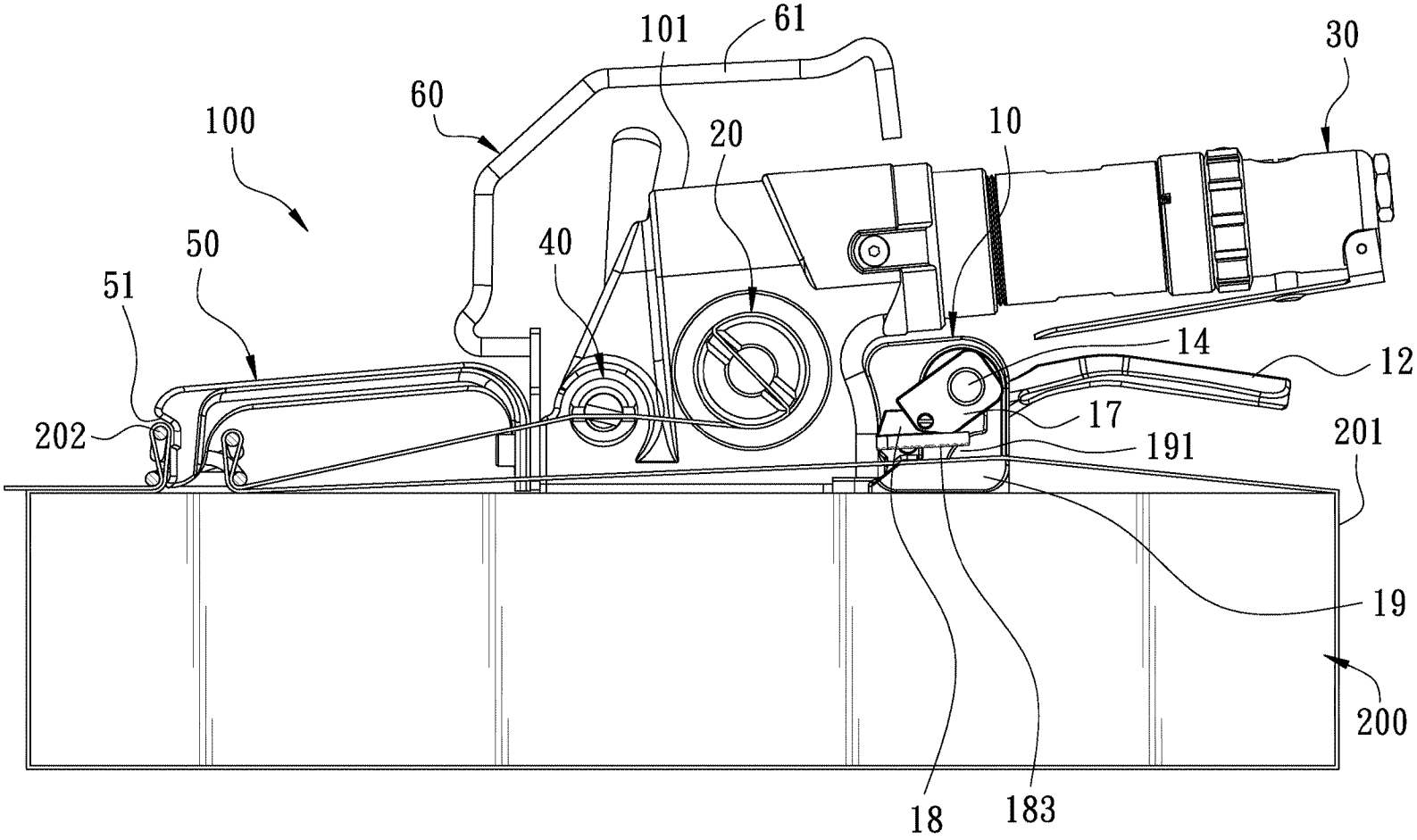
FIG. 4 is a schematic view of the present invention when in use, showing the operation of a handle.
Figure 5:
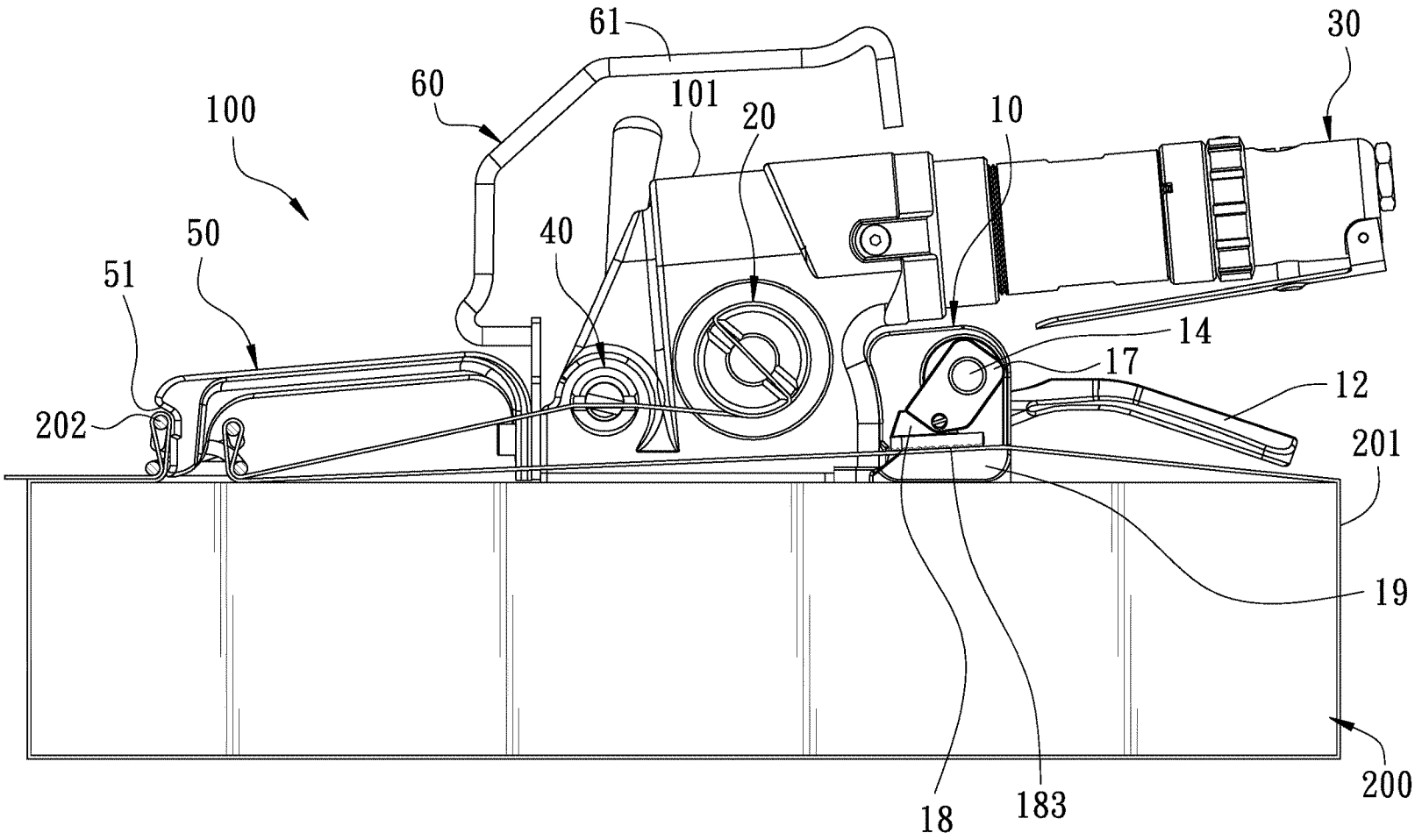
FIG. 5 is a schematic view of the present invention when in use, showing a belt pressing device used to press a packing belt.

Referring to FIGS. 4 and 5, in cooperation with FIG. 3, when the packing tool 100 is used to pack an article 200, a first end of a packing belt 201 is first wound and retained to a first side of a packing buckle 202, and the press surface 51 of the press member 50 is pressed against the first side of the packing buckle 202, and then the packing belt 201 is wound around the outer circumference of the article 200. The second end of the packing belt 201 is wound around the second side of the packing buckle 202, and then the user holds the power unit 30 to operate the packing tool 100. The user can hold the power unit 30 with the thumb and forefinger of the hand. The handle 12 is lifted up by the other fingers. The toothed portion 121 drives the gear 16 to rotate the shaft 14. The shaft 14 drives the interlocking block 17 and the spring 15 to rotate, and the interlocking block 17 drives the belt pressing block 18 to turn. The spring 15 drives the belt pressing block 18 to form a passage 191 between the belt pressing block 18 and the press plate 19, and then the packing belt 201 is inserted through the passage 191 (as shown in FIG. 4). After that, the handle 12 is released. The return spring 13 restores the handle 12 to its normal state so that the belt pressing block 18 and the press plate 19 are pressed tightly again. The bite surface 183 of the belt pressing block 18 is used to bite the packing belt 201 tightly (as shown in FIG. 5), and then the second end of the packing belt 201 is wound around the belt winding device 20. The power unit 30 is actuated to drive the belt winding device 20 to tighten the packing belt 201. Finally, the unnecessary packing belt 201 is cut by the belt cutting device 30 to complete the packaging operation.

Figure 6:
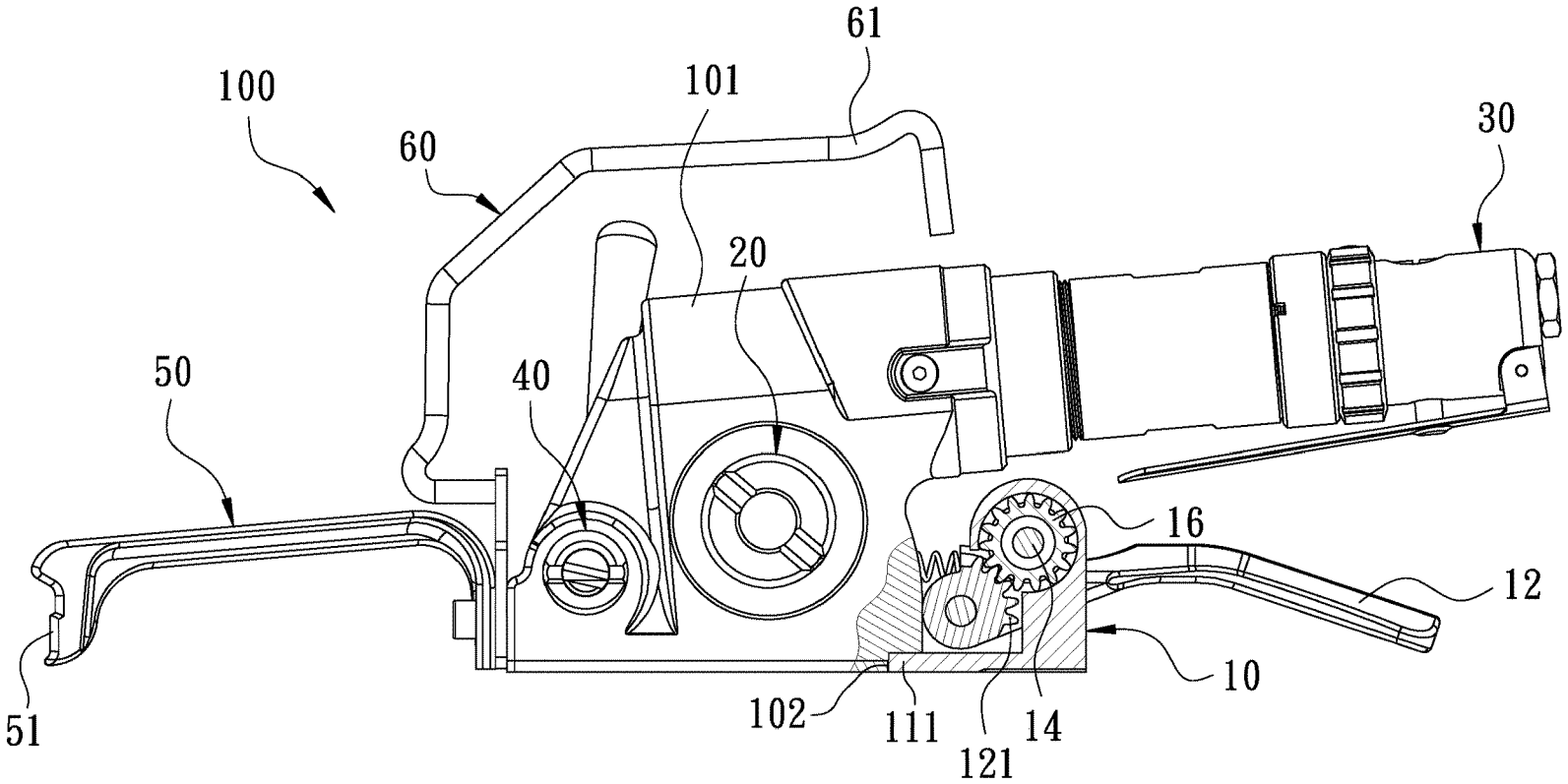
FIG. 6 is a partial sectional view of the present invention, showing a gear to mesh with a toothed portion.

Referring to FIG. 6, when the handle 12 is turned, the toothed portion 121 drives the gear 16 to rotate. Since the meshing density between the toothed portion 121 and the gear 16 is high through a plurality of teeth to mesh with each other, so that the gear 16 can be surely rotated to drive the belt pressing device 10. The toothed portion 121 and the gear 16 can be easily disassembled when the toothed portion 121 and the gear 16 remain the packing belt after use.

The belt pressing device 10 of the present invention is located under the power unit 30 so that the user can hold the power unit 30 with the thumb and forefinger of the hand and lift the handle 12 with the other fingers. The packing tool 100 of the present invention can be firmly held by one hand to operate the belt pressing device 10.

It is worth mentioning that the belt pressing device 10 is detachably mounted to the main body 101 by means of the screw 114, and the belt cutting device 40 is detachably mounted to the mounting hole 104, and the press member 50 and the hanger 60 are screwed to the front end of the packing tool 100. Thereby, the modular design facilitates the user to assemble the packing tool 100 conveniently in accordance with the requirement of use so as to set the function and the weight of the packing tool 100.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A packing tool comprising:

a main body;

the main body being provided with a belt pressing device, a belt winding device and a power device;

the belt pressing device including a belt pressing seat, the belt pressing seat being fixed to the main body, a first side of the belt pressing seat being pivotally connected with a handle, the handle having a toothed portion and an accommodation portion, a return spring being provided in the accommodation portion, an elastic end of the return spring leaning against the main body, the belt pressing seat having a through hole, the through hole being provided with a shaft and a spring, a first end of the shaft being provided with a gear, the gear meshing with the toothed portion, a second end of the shaft extending out of the belt pressing seat and being provided with a belt pressing block, the spring being fitted on the shaft, a fixed end of the spring being connected to the shaft, an elastic end of the spring leaning against the belt pressing block, a second side of the belt pressing seat being provided with a press plate adjacent to the belt pressing block;

thereby, the handle being operated to drive the gear through the toothed portion to lift the belt pressing block so that a passage is formed between the belt pressing block and the press plate.

2. The packing tool as claimed in claim 1, wherein the main body has a recess at a bottom thereof, the belt pressing seat includes a fixed plate adjacent to the recess, and the fixed plate is fixed to the recess with a screw.

3. The packing tool as claimed in claim 1, wherein the first side of the belt pressing seat has a pivot hole, and the handle is fixed to the pivot hole with a fixing member.

4. The packing tool as claimed in claim 1, wherein the second end of the shaft is sleeved with an interlocking block, the interlocking block is provided with a pin, the pin is inserted in the interlocking block and the shaft, and the interlocking block is pivotally connected with the belt pressing block.

5. The packing tool as claimed in claim 4, wherein the interlocking block has two limit recesses, the belt pressing block includes two limit blocks, one of the two limit blocks is adjacent to one of the two limit recesses, the other one of the two limit blocks is adjacent to the other one of the two limit recesses, and a pivot is inserted through the two limit recesses and the two limit blocks.

6. The packing tool as claimed in claim 1, wherein a bottom surface of the belt pressing block has a bite surface, and the bite surface is serrated.

7. The packing tool as claimed in claim 1, wherein the main body has a mounting hole, and a belt cutting device is mounted to the mounting hole of the main body.

8. The packing tool as claimed in claim 1, wherein a front end of the packing tool are threadedly connected with a press member and a hanger, the press member has a press surface, and the hanger includes a fixing bar.

9. The packing tool as claimed in claim 1, wherein the belt pressing device is located under the power unit, one side of the main body has an accommodation hole corresponding to the belt pressing device, and the elastic end of the return spring leans against the accommodation hole of the main body.

* * * * *